US007784794B2

(12) United States Patent
Sitton

(10) Patent No.: US 7,784,794 B2
(45) Date of Patent: Aug. 31, 2010

(54) PAPER ARCHERY TUNER

(76) Inventor: Wesley Gary Sitton, 390 Honey Run Rd., Chico, CA (US) 95928

( * ) Notice: Subject to any disclaimer, the term of this patent is extended or adjusted under 35 U.S.C. 154(b) by 3 days.

(21) Appl. No.: 11/880,489

(22) Filed: Jul. 23, 2007

(65) Prior Publication Data

US 2009/0026708 A1 Jan. 29, 2009

(51) Int. Cl.
*F41J 3/00* (2006.01)
*F41J 1/00* (2006.01)

(52) U.S. Cl. ..... 273/348; 273/403; 273/407; 273/408

(58) Field of Classification Search ..... 273/348, 273/380, 403, 404, 407, 408, 409
See application file for complete search history.

(56) References Cited

U.S. PATENT DOCUMENTS 398,186 A * 2/1889 Rehfuss ..... 273/404
840,610 A * 1/1907 Easdale ..... 273/404
2,034,839 A * 3/1936 Sheffield ..... 273/382
2,048,155 A * 7/1936 Armantrout ..... 273/407
4,629,188 A * 12/1986 Mahieu ..... 473/454
5,169,157 A * 12/1992 Salmon ..... 273/407
5,829,753 A * 11/1998 Wiser ..... 273/407
6,257,584 B1 * 7/2001 Nasuti ..... 273/407
6,543,778 B2 * 4/2003 Baker ..... 273/407

* cited by examiner

*Primary Examiner*—John Ricci

(57) ABSTRACT

A frame structure holds a paper roll in the top part and releasable spring loaded pressure bars hold the roll and the leading edge of the paper stretched taut across the frame for shooting arrows through the paper and release to allow feeding a hole-free portion of paper from the roll. Once the paper is fed, springs pull the pressure bars together to apply pressure to the top of the paper roll and the leading edge of the paper on the opposite side of the frame so that the paper is held tight. An arrow may be shot through the tight paper to determine the trueness of flight. If the arrow flies true, the tear of the fletching is evenly spaced around the hole of the shaft.

9 Claims, 1 Drawing Sheet

PAPER ARCHERY TUNER

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to targets for weapons and particularly to a target stand for tuning arrow flight which comprises a vertical frame structure that dispenses paper from a roll held at the top of the frame, the leading edge of the paper is fed through the center of the frame and springs attached between the ends of an upper pressure bar and a lower pressure bar apply pressure to the top of the paper roll and the leading edge of the paper so that the paper is held taut and an arrow may be shot through the tight paper to determine the trueness of flight; the top pressure bar being lifted to relieve tension on the paper roll so that more paper may be advanced, and the top pressure bar being released to apply pressure to the top of the paper roll so that it will not roll; a bottom pressure bar being moved to relieve tension on the leading edge of the paper so that the paper may be pulled through the frame, and the bottom pressure bar being released to apply pressure to the leading edge of the paper, holding it tight.

2. Description of Related Art including information disclosed under 37 CFR 1.97 and 1.98

Target shooting is normally defined as the sport of firing a projectile, such as a bullet or an arrow, at targets of various kinds with rifles, handguns, shotguns, and/or a bow and arrow. Shooting at a target as a test of skill has its origins with archery, but is also used to for tuning the trueness of the flight of an arrow.

In the sport of archery, having an arrow fly straight improves accuracy. One tests arrow flight straightness by shooting an arrow through taut paper. After a shot through taut paper, an archer observes a hole made from the point and shaft of the arrow and tears that represent the arrow fletching (feathers or vanes on the back of the arrow). If the arrow flies straight, the fletching tears are equally spaced around the shaft hole. If the fletching tears are right, left, high or low relative to the shaft hole, one adjusts either the nocking point on the bow string or the arrow rest or both.

The prior art fails to provide an easy-to-use relatively inexpensive means for testing and tuning the trueness of arrow flight.

U.S. Pat. No. 5,829,753, issued Nov. 3, 1998 to Wiser, describes a multifunction portable target stand and dispenser comprising an assembly for holding a target. A structure is pivotally connected to the holding assembly, for supporting the holding assembly in an upright position above the ground when the supporting structure is in an extended position, so that a person with a shooting weapon at a remote location on the ground can shoot at the target. A facility on the supporting structure is for transporting the multifunction portable target stand to another location, when the supporting structure is in a folded up position. An alternate embodiment is provided which uses a roll of perforated paper targets placed within the target compartment.

U.S. Pat. No. 5,031,920, issued Jul. 16, 1991 to Poirier, indicates a shooting range that has a target chamber position at the target end. A camera on the chamber transmits an image of the target to the shooting end where it is displayed on a screen of a video micrometer. The video micrometer has cross hair reticules that measure a shot pattern generated on the target. The video micrometer has a tape recorder for recording the transmitted image, a printer for printing a hard copy of the pattern, a keyboard for data input, and is connectable to a computer for input of the shot pattern data. A dispenser is mounted under the chamber and is attached to the bottom of the chamber. The dispenser is arranged to hold a supply of continuous targets that are either fan folded or supplied on a continuous roll.

U.S. Pat. No. 6,543,778, issued Apr. 8, 2003 to Baker, is for a paper roll target apparatus. The target assembly includes special paper on which a target is imprinted and which is stored on a feeder roll in a frame and which is moved past a target area in the frame to either a take-up roll or to an exit slot. If the paper passes through the exit slot, it can be moved past a cutting slot and cut off using a knife or the like. The paper is special rosin sized sheathing, such as forty pound wax paper, which retains the desired orientation during a target shoot, as well as makes clean, precise holes when impacted by shot whereby a precise record of a shot is made. An area on the paper adjacent to each target can be used to record data pertinent to the shot whereby a firearm can be sighted in or a load adjusted.

U.S. Pat. No. 6,257,584, issued Jul. 10, 2001 to Nasuti, provides a shooting target apparatus which comprises a supply rod having a first portion and a second portion. A receiver rod has a third portion and a fourth portion. A tubular target dispenser has a hollow portion and has a number of targets and receives the supply rod. The target is coupled over the dispenser and extends to the receiver rod. The first, second, third and fourth portions are sized to be received within the hollow portion.

U.S. Pat. No. 2,048,155, issued Jul. 21, 1936 to Armantrout, claims a collapsible folding target frame which holds a continuous roll of targets. The targets are drawn upwardly and held in place by a clamping bar.

U.S. Pat. No. 398,186, issued Feb. 19, 1889 to Rehfuss, describes a target having a continuous roll of targets which are advanced using a drive mechanism cord pulled by the marksman. The device is provided with a rigid metal plate surrounding the periphery of the active target to protect the unused target roll and includes a bullet trap behind the active target to catch bullets fired there through.

U.S. Pat. No. 1,981,293, issued Nov. 20, 1934 to Varrelman, discloses a target range comprising relatively large and heavy target holding frame with a metal back-stop and a bullet trap.

U.S. Pat. No. 4,583,744, issued Apr. 22, 1986 to Tolliver, concerns a projectile capturing device and target assembly that includes a housing in which are mounted a plurality of interceptors made of flexible, energy absorbing material that hang down behind a target face mounted thereon. Preferably, three such interceptors hang from a downwardly, rearward sloping rear wall of the housing. A continuous roll of adjacent target faces is mounted in the lower portion of the housing, each successive target face being hooked to the top of the housing for use. The target faces are made of a polymeric material having a color contrasting to the color of the interceptors.

U.S. Pat. No. 840,610, issued Jan. 8, 1907 to Easdale, illustrates a bullet-stopping target having a continuous roll of targets which are moved from one roller to another using a pawl and ratchet mechanism.

U.S. Pat. No. 3,519,272, issued Jul. 7, 1970 to DeVogelaere, is for a portable light-weight training device for use with dummy ammunition. A nylon shield "S" provides a back-stop for projectiles having traveled through the roll-type paper target.

U.S. Pat. No. 3,402,933, issued Sep. 24, 1968 to DeVogelaere, provides a portable light-weight training device with marksman training target film which is used to project images of targets onto a roll of plain paper.

U.S. Pat. No. 2,034,839, issued Mar. 24, 1936 to Sheffield, shows an automatic target device which utilizes rolls or reels upon which target material is wound.

U.S. Pat. No. 4,247,116, issued Jan. 27, 1981 to McQuary, claims an indicating target system for use with spring, air, and CO.sub.2 operated pistols and rifles and with slingshots. The target system prevents ricochets by use of a flexible backstop suspended within a housing while permitting the shooter and spectators to easily discern where the projectiles have penetrated a target which is disposed across the front of this housing. The system utilizes supports incorporated into the housing to receive tubes upon which the target is wound for easy movement and removal of used targets and installation of a new roll of targets to replace a used roll. Each individual target on the roll is indexed to a display position by hand winding of the tubes. A locking mechanism incorporated into the supports cooperates with the tubes and wound target material to tautly position each target in the target opening. A chamber in the base of the apparatus entraps projectiles, permitting collection and removal without damage for reuse.

U.S. Pat. No. 5,169,157, issued Dec. 8, 1992 to Salmon, discloses an automatic target holder for positioning targets for projectiles at a location remote from a shooter. The target holder includes a housing having a relatively low silhouette and a target support removably mounted upon the housing for positioning a target in a substantially planar firing position normal to a path of a projectile fired by the shooter. A target drive mechanism is located within the housing and is remotely operable by the shooter to advance a target roll to move a new target into the firing position. The target support structure and the housing is oriented outboard of the target in the firing position providing an unobstructed path for the projectile as it passes through the target. The preferred embodiment is provided with a target illumination panel positioned behind the target and shiftable between an inactive position out of the projectile path and an active position behind the target in order to increase the visibility of the projectile holes formed in the target.

What is needed is a frame structure that provides for dispensing paper from a roll and holds the dispensed paper taut for use in the field of archery to tune the flight of an arrow by shooting the arrow through the taut sheet of paper and observing the tear in the paper produced by the fletching or feathers compared with the hole produced by the point and shaft of the arrow so that if the tear is evenly spaced around the shaft hole that is an indication that the arrow flies true.

BRIEF SUMMARY OF THE INVENTION

An object of the present invention is to provide a frame structure that provides for dispensing paper from a roll and holds the dispensed paper taut for use in the field of archery to tune the flight of an arrow by shooting the arrow through the taut sheet of paper and observing the tear in the paper produced by the fletching or feathers compared with the hole produced by the point and shaft of the arrow so that if the tear is evenly spaced around the shaft hole that is an indication that the arrow flies true.

In brief, in the sport of archery, having an arrow fly straight improves accuracy. One tests arrow flight straightness by shooting an arrow through taut paper. After a shot through taut paper, one observes a hole made from the point and shaft of the arrow and tears that represent the arrow fletching (feathers or vanes on the back of the arrow). If the arrow flies straight, the fletching tears are equally spaced around the shaft hole. If the fletching tears are right, left, high or low relative to the shaft hole, one adjusts either the nocking point on the bow string or the arrow rest or both. This invention holds the paper taut and provides a convenient means whereby paper may be advanced and a new paper roll may be inserted. The top of the unit holds a roll of paper on a dowel. The paper is fed from this roll along the front of the unit and the leading edge is then fed below a bottom member of the unit, out the back of the unit. Top and bottom pressure bars are used to apply pressure to the paper roll and the bottom member so that the paper does not slip, once taut. The pressure is applied by two extension springs attached outside the unit, hooked over each of the two ends of the top and bottom pressure bars. Thus, to advance paper, one pulls up on the top pressure bar, pulls paper out toward the front of the unit and then releases and activates the top pressure bar; next, one pulls down on the bottom pressure bar, pulls the paper taut out the back of the unit and releases and activates the bottom pressure bar. This creates a taut paper surface through which an arrow may be shot. This invention also has application in continuous ballistic target presentation; and, as well, meeting note taking or painting.

An advantage of the present invention is that it provides an accurate test for the trueness of flight of an arrow that is easy to perform.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
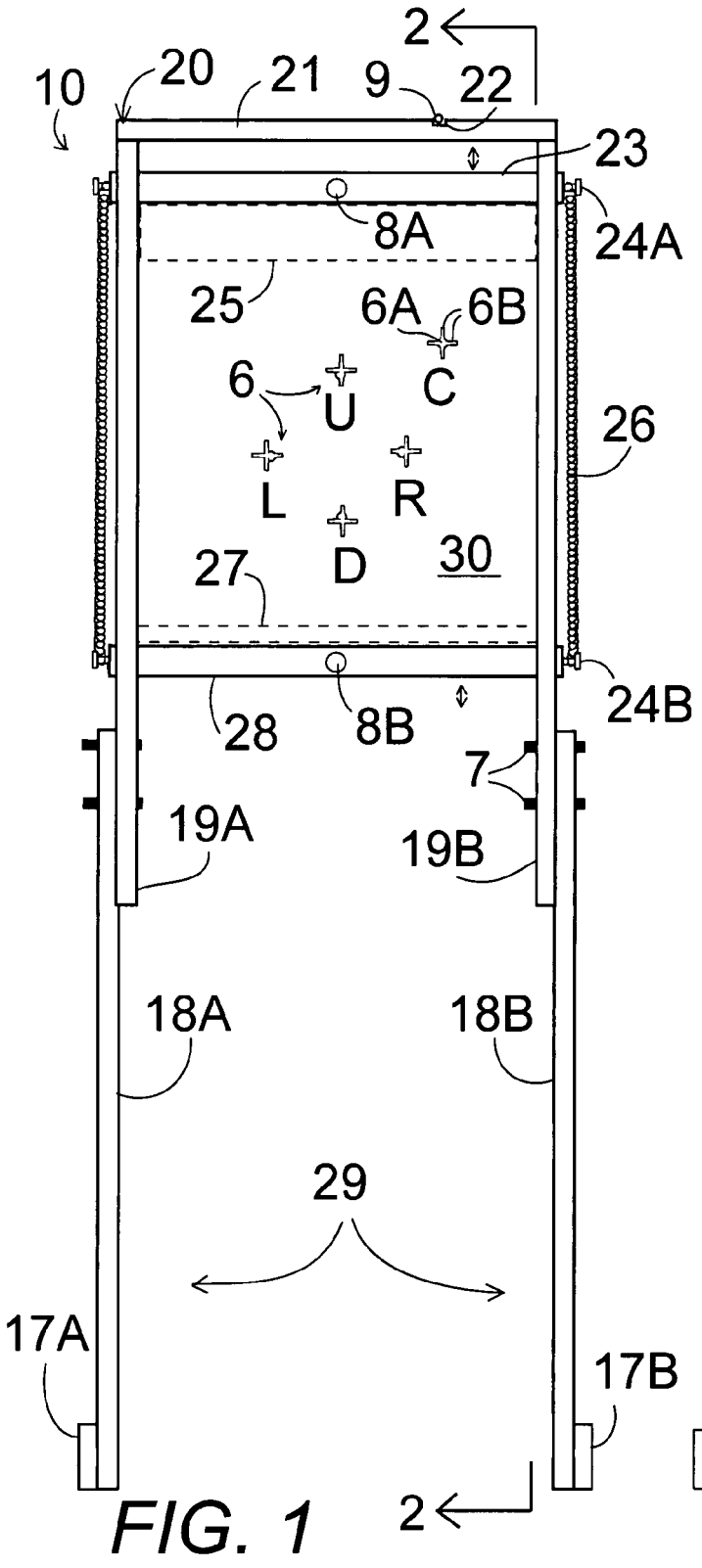
FIG. 1 is a front elevational view of the archery arrow flight testing paper stretching frame of the present invention showing various arrow holes made through the paper.
Figure 2:
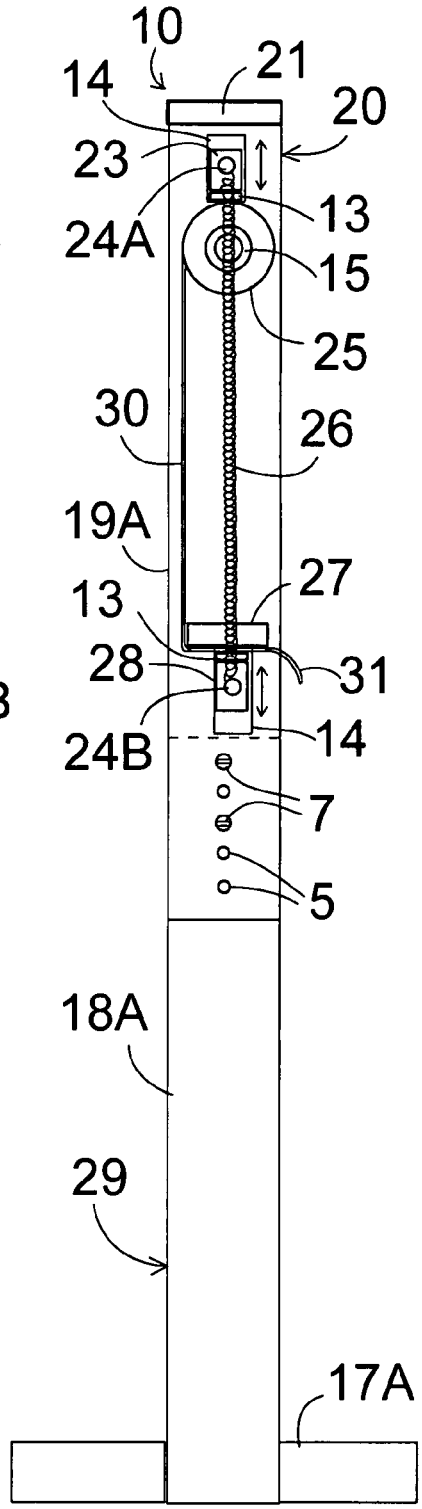
FIG. 2 is a side elevational view of the archery arrow flight testing paper stretching frame taken through 2-2 of FIG. 1 without the facing side on the frame to show the details of the roll of paper, the paper end ridge, and the two pressure bars.

In FIGS. 1 and 2, an archery arrow flight test stand device 10 for testing and tuning trueness of flight of arrows comprises adjustable height legs 29 by using threaded fasteners 7 in a series of vertically spaced holes 5 on legs 18A and 18B, which have elongated feet 17A and 17B attached at the bottom for stability, the legs supporting a vertical frame structure 20 at a desired height above the ground, the test stand having a renewable supply of paper 30 stretched taut across the frame for receiving arrows shot therethrough for observing the arrow holes 6.

A roll of paper 25 is rotatably attached on a dowel 15 to two opposing frame members 19A and 19B adjacent to a first side of the vertical frame structure 20, which is preferably the top side.

A roll clamping pressure bar 23 is slidably attached in slots 14 to the two opposing frame members 19A and 19B adjacent to the first side of the vertical frame structure (preferably the top side) adjacent to the roll of paper 25 and parallel to the roll of paper for normally pressing against the roll of paper 25 along the entire length of the roll of paper to prevent movement of the roll of paper 25 and alternately being released by a user from the roll of paper 25 to allow dispensing of the paper 30 from the roll of paper 25.

A paper receiving ridge 27 is rigidly attached to the two opposing frame members 19A and 19B adjacent to a second side of the vertical frame structure (preferably the bottom side adjacent to the top of the legs 18A and 18B) opposite the first side and spaced apart from the roll of paper 25, the paper 30 from the roll of paper stretched over a forward edge of the ridge 27 facing an archer with the cut or ripped off forward edge of the paper extending out the back of the vertical frame structure 20.

A paper end clamping pressure bar 28 is slidably attached in slots 14 in the two opposing frame members 19A and 19B adjacent to the second side of the vertical frame structure (the bottom of the frame structure 20 near where it meets the legs 18A and 18B adjacent to the paper receiving ridge 27 and parallel to the paper receiving ridge for normally pressing against the paper 30 along the entire width of the paper pressing the paper 30 against the bottom of the paper receiving ridge 27 to stretch the paper 30 taut between the roll of paper 25 and the paper receiving ridge 27 and alternately being released by a user from the paper receiving ridge 27 to allow a new section of paper 30 to be dispensed from the roll of paper 25 and stretched over the paper receiving ridge 27.

A pair of tension elements, preferably tension springs 26 are stretched between the roll clamping pressure bar 23 and the paper end clamping pressure bar 28 on protruding capped rods 24A and 24B on the aligned ends of the bars for normally pressing the roll clamping pressure bar 23 against the roll of paper 25 and normally pressing the paper end clamping pressure bar 28 against the end of the paper 30 stretched over the paper receiving ridge 27; thereby forming a renewable taut smooth unbroken paper 30 surface for receiving arrows shot therethrough to make holes 6 for testing and tuning for trueness of flight of the arrows by observing a hole 6A made from the point and shaft of the arrow and tears 6B made by the arrow fletching or feathers passing through so that if the arrow flies straight, the fletching tears 6B are equally spaced around the shaft hole 6A, as in C. If the fletching tears 6B are right as in R, left as in L, high or up as in U or low or down as in D relative to the shaft hole 6A, tuning by relevant adjustments can be made to a nocking point on the bow string or the arrow rest or both to readjust the flight of the arrows until trueness of flight is achieved as in C.

A high friction surface 13 may be applied to the roll clamping pressure bar 23 to assist in clamping the roll of paper 25 to prevent movement of the roll of paper 25 and a high friction surface 13 may also be applied to the paper end clamping pressure bar 28 to assist in clamping the end of the paper 30 to the paper end receiving ridge 27 to prevent movement of the end of the paper 30.

A finger hole 8A in the roll clamping pressure bar 23 or other means may be used for gripping the roll clamping pressure bar 23 and a finger hole 8B or other means may be used for gripping the paper end clamping pressure bar 28 for moving the bars.

A top vertical frame member 21 may have a groove 22 or other means for holding at least one marking instrument 9 on the vertical frame structure 20 for use in marking the paper 30.

In use, the device of the present invention holds paper 30 taut so that you can tune the flight of an arrow. It preferably uses an 18" roll of paper which is placed on the top dowel 15. The end of the paper is fed between the paper end receiving ridge 27 and the paper end clamping pressure bar 28 at the bottom of the vertical frame structure 20. The paper end 31 is pulled taut and then the paper 30 is held in place by top and bottom pressure bars 23 and 28 with the tension springs 26 pulling the bars against the roll of paper 25 and the paper 30 against the paper end retainer ridge 27.

To advance the paper 30 to have a smooth hole-free section exposed, the paper roll clamping bar 23 is lifted and then released after sufficient paper has been advanced. The paper roll clamping bar 23 now holds the roll stationary while the paper 30 is stretched taut under the paper end receiving ridge 27 with the paper end clamping bar 28 lowered and then released to hold the paper taut for shooting the arrows through the taut paper 30. The pen is provided for quickly drawing "target" circles and/or marking completed shots.

It is understood that the preceding description is given merely by way of illustration and not in limitation of the invention and that various modifications may be made thereto without departing from the spirit of the invention as claimed.

What is claimed is:

1. An archery arrow flight test device for testing and tuning trueness of flight of arrows, the device comprising:

an arrow test stand for tuning arrow flight which comprises a vertical frame structure, adjustable height legs supporting the vertical frame structure at a desired height above the ground;

a roll of paper rotatably attached to the vertical frame structure adjacent to a first side of the vertical frame structure;

a roll clamping pressure bar slidably attached to the vertical frame structure adjacent to the first side of the vertical frame structure adjacent to the roll of paper and parallel to the roll of paper for normally pressing against the roll of paper along the entire length of the roll of paper to prevent movement of the roll of paper and alternately being released by a user from the roll of paper to allow dispensing of the paper from the roll of paper;

a paper receiving ridge rigidly attached to the vertical frame structure adjacent to a second side of the vertical frame opposite the first side and spaced apart from the roll of paper, the paper from the roll of paper stretched over a forward edge of the ridge facing an archer;

a paper end clamping pressure bar slidably attached to the vertical frame structure adjacent to the second side of the vertical frame structure adjacent to the paper receiving ridge and parallel to the paper receiving ridge for normally pressing against the paper along the entire width of the paper pressing the paper against the paper receiving ridge to stretch the paper taut between the roll of paper and the paper receiving ridge and alternately being released by a user from the paper receiving ridge to allow a new section of paper to be dispensed from the roll of paper and stretched over the paper receiving ridge; and a pair of tension elements stretched between the roll clamping pressure bar and the paper end clamping pressure bar on the aligned ends of the bars for normally pressing the roll clamping pressure bar against the roll of paper and normally pressing the paper end clamping pressure bar against the end of the paper stretched over the paper receiving ridge; thereby forming a renewable taut smooth unbroken paper surface for receiving arrows shot therethrough for testing and tuning for trueness of flight of the arrows by observing a hole made from the point and shaft of the arrow and tears made by the arrow fletching passing through so that if the arrow flies straight, the fletching tears are equally spaced around the shaft hole and if the fletching tears are right, left, high or low relative to the shaft hole, tuning by relevant adjustments can be made to a nocking point on the bow string or the arrow rest or both to readjust the flight of the arrows until trueness of flight is achieved.

2. The device of claim 1 further comprising a dowel removably attached to the vertical frame structure for receiving replaceable rolls of paper thereon.

3. The device of claim 1 further comprising a high friction surface applied to the roll clamping pressure bar to assist in clamping the roll of paper to prevent movement of the roll of paper.

4. The device of claim 1 further comprising a high friction surface applied to the paper end clamping pressure bar to assist in clamping the end of the paper against the paper end receiving ridge to prevent movement of the end of the paper.

5. The device of claim 1 further comprising a means for gripping the roll clamping pressure bar and the paper end clamping pressure bar for moving the bars.

6. The device of claim 5 wherein the means for gripping the bars comprises at least one finger hole in each of the bars.

7. The device of claim 1 further comprising a means for holding at least one marking instrument on the vertical frame structure.

8. The device of claim 1 wherein the tension members comprise a tension spring attached between a first end of the roll clamping pressure bar and a first end of the paper end clamping pressure bar and a tension spring attached between a second end of the roll clamping pressure bar and a second end of the paper end clamping pressure bar.

9. The device of claim 1 wherein the vertical frame structure comprises slots therein and the bars each have a pin extending from each end which slides within one of the slots.

* * * * *